US006275017B1

(12) United States Patent
Germanski et al.

(10) Patent No.: US 6,275,017 B1
(45) Date of Patent: Aug. 14, 2001

(54) START-UP CIRCUIT FOR VOLTAGE REGULATOR WITH CURRENT FOLDBACK

(75) Inventors: Vasil Germanski, Washington; Timothy P Philippart, Royal Oak; Mikhail Zarkhin, West Bloomfield; Mark J Stachew, Fenton, all of MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/578,383

(22) Filed: May 25, 2000

(51) Int. Cl.[7] ..... G05F 1/40
(52) U.S. Cl. ..... 323/273; 323/901
(58) Field of Search ..... 323/266, 270, 323/271, 273, 282, 901; 307/31, 32, 36, 42

(56) References Cited

U.S. PATENT DOCUMENTS

| | | | | |
|---|---|---|---|---|
| 3,958,168 | | 5/1976 | Grundberg . | |
| 4,418,375 | | 11/1983 | Ober . | |
| 4,705,013 | | 11/1987 | Minks . | |
| 4,829,971 | | 5/1989 | Minks . | |
| 4,836,323 | | 6/1989 | Kataoka et al. . | |
| 4,944,281 | | 7/1990 | Suquet . | |
| 4,959,786 | | 9/1990 | Glowczewski et al. . | |
| 5,043,633 | | 8/1991 | Perkins . | |
| 5,323,102 | * | 6/1994 | Wind et al. | 290/40 A |
| 5,418,401 | * | 5/1995 | Kaneyuki | 307/10.1 |
| 5,694,305 | | 12/1997 | King et al. . | |
| 5,710,697 | | 1/1998 | Cooke et al. . | |
| 5,852,332 | * | 12/1998 | Shearer | 307/43 |
| 5,880,674 | * | 3/1999 | Ufkes et al. | 340/438 |
| 5,994,885 | | 11/1999 | Wilcox et al. . | |
| 5,998,881 | * | 12/1999 | Wind et al. | 290/40 A |
| 6,046,512 | | 4/2000 | Heise . | |

* cited by examiner

*Primary Examiner*—Matthew Nguyen
(74) *Attorney, Agent, or Firm*—Mark P. Calcaterra

(57) ABSTRACT

It is an object of the present invention to provide an assist circuit for a vehicle controller power supply which requires multiple voltage outputs. The assist circuit allows for the supply of a higher voltage which aids the supply of a lower voltage during transient power up. Once both voltages have achieved a specified level, during transient power up, and other power supply components, such as a linear voltage regulator, have stabilized, the assist circuit effectively switches off, allowing the higher voltage to be supplied by a switching power supply and the lower voltage to be supplied by the linear regulator. The assist circuit is most useful in vehicle controllers which have a current foldback feature, by assisting to supply peak current demands before a current foldback can occur during a transient power up stage.

14 Claims, 2 Drawing Sheets

START-UP CIRCUIT FOR VOLTAGE REGULATOR WITH CURRENT FOLDBACK

FIELD OF THE INVENTION

The present invention relates generally to vehicle controllers and more particularly to vehicle controllers which have a power supply with current foldback features.

BACKGROUND AND SUMMARY OF THE INVENTION

Vehicle controllers are typically powered by a power supply which offers a dual voltage output. The higher of the two voltage commonly powers the input/output (I/O) ring of the controller which comprises logic gates requiring a standard voltage level. The lower voltage level powers the internal bus logic of the digital core. The lower voltage output is becoming a necessity because of the increasing speed and lower power target of modern microprocessors. The source of the lower voltage output typically contains a current limiting and current foldback feature which controls and reduces the amount of power dissipation during a short circuit.

At a power on event, the higher and lower voltage gradually ramp up to their designed voltage level. The higher voltage is generated directly from a switching power supply, whereas the lower voltage results from feeding the higher back through a linear voltage regulator. Therefore, during the voltage ramp up, the controller monitors the ramping of the higher voltage and begins to ramp up the lower voltage at a designated point. This designated point is a function of the differential which must be maintained between the higher and lower voltage.

The vehicle controller power supply protects itself in the event of a short circuit by having a current foldback feature. Both the higher and lower voltage sources are designed to handle a specified operating current. If the transient current load during power up is higher than the maximum normal operating current of the lower voltage source, the foldback feature will never allow it to reach its designated voltage value. As a result, the specified differential between the higher and lower voltage is violated. Typically the short circuit current value is 15–20% of the maximum steady -state current. By the foldback feature limiting the current to this value, the lower voltage will not achieve its steady -state.

It is an object of the present invention to provide a circuit which prevents the lower voltage source from being held by the foldback feature in response to large transient demands during power up.

This invention is directed to a power up assist circuit for use with a multiple voltage output power supply. The power up assist circuit includes a first circuit loop. The first circuit loop has a first voltage output. A second circuit loop has a second voltage output. During an initial power up stage, the first circuit loop supplies the second voltage output so that the second voltage output is assisted by the first voltage output through the first circuit loop. The second circuit loop deactivates the first circuit loop after the second voltage output achieves a predetermined value so that the first circuit loop no longer supplies said second voltage output.

Implementation of the assist circuit of the present invention does not allow the higher and lower voltages to violate the specified difference between the two. Therefore, the controller remains operable, not going into a foldback state upon a large transient demand.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

Figure 1:
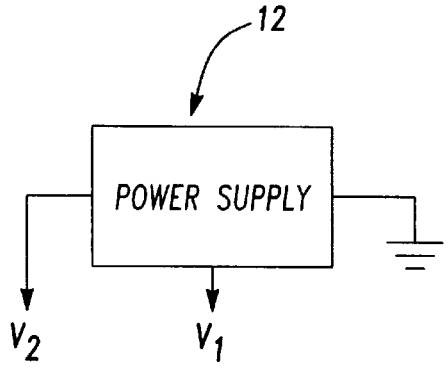
FIG. 1 is a schematic view of a power source according to the principles of the present invention.

The embodiment of the present invention is merely exemplary in nature and is not intended to limit the invention or its applicability. With reference to FIG. 1, a schematic view of a typical dual output power supply is shown. The power supply 12 sources loads $V_1$ and $V_2$.

Figure 2:
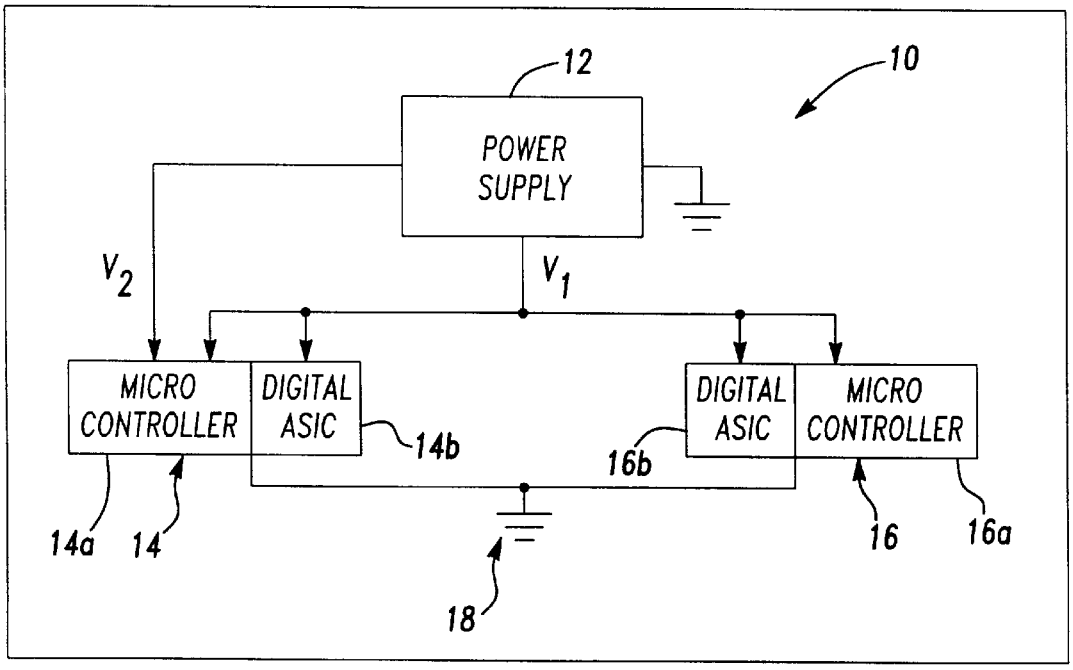
FIG. 2 is a schematic view of a vehicle controller according to the principles of the present invention.

FIG. 2 is a detailed schematic view of an exemplary vehicle controller 10. The vehicle controller 10 comprises a plurality of sub-controllers 14, 16, a power supply 12 and multiple intermediate circuits (not shown). It should be noted that a preferred embodiment of the present invention uses two sub-controllers 14, 16 but does not limit the use of more or fewer sub-controllers. In the preferred embodiment, sub-controller 14 is an engine controller comprising a micro-controller 14*a* and a digital application specific integrated circuit (ASIC) 14*b*. Sub-controller 16 is a transmission controller comprising a micro-controller 16*a* and a digital ASIC 16*b*.

Power supply 12 supplies the controllers with multiple voltage outputs $V_1$ and $V_2$. It should be noted that $V_1$ (the higher voltage) has a greater value than $V_2$ (the lower voltage). Again, the preferred embodiment of the present invention does not limit the use of more or fewer voltage outputs. As shown in FIG. 1, voltage $V_1$ supplies micro-controller 14*a*, digital ASIC 14*b*, micro-controller 16*a*, and digital ASIC 16*b*. Both engine controller 14 and the transmission controller 16 share a common reference ground 18. The micro-controller 14*a* of the engine controller 14 also requires the lower voltage $V_2$ supplied by the power supply 12.

Figure 3:
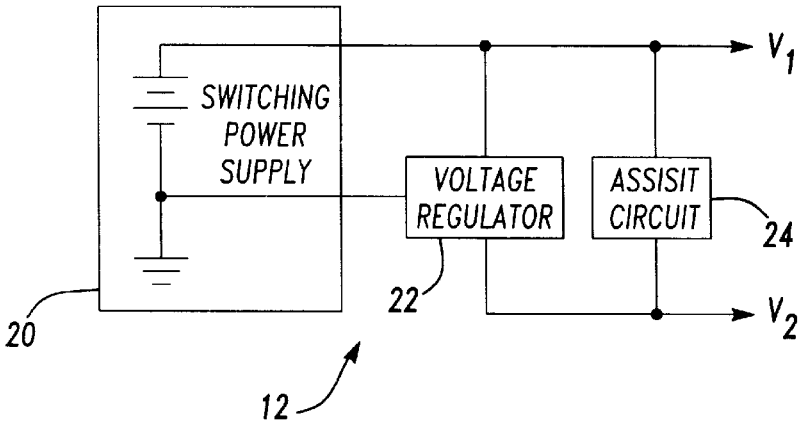
FIG. 3 is a schematic layout of a portion of the vehicle controller power supply of FIG. 2.

The power supply 12 is further detailed in FIG. 3. The main power source within the power supply 12 is a switching power supply 20. The switching power supply 20 generates the higher voltage $V_1$ which is then fed back into a linear voltage regulator 22 to generate the lower voltage $V_2$. The power supply 20 is capable of sourcing transient demands even during the initial transient power up stage of the circuit.

Figure 4:
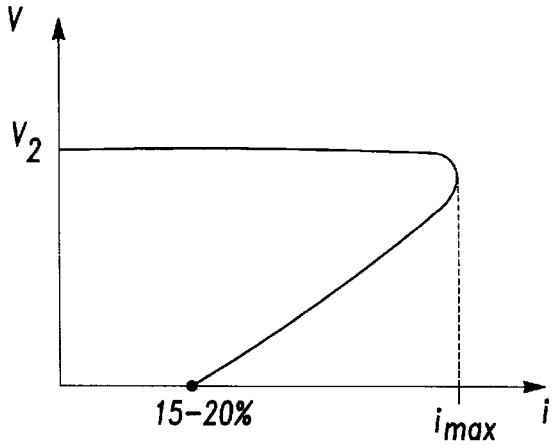
FIG. 4 is a graph of the current characteristics of a voltage regulator with the foldback feature.

During power up, the linear voltage regulator 22 does not sufficiently handle transient demands. Additionally, the linear voltage regulator 22 is configured to have a current foldback means to avoid possible damage to the power supply 12. As a result, if any peak load demands are placed upon the linear voltage regulator 22 by the engine microcontroller 14*a*, the power supply 12 goes into a current foldback state. This foldback reaction is best shown in FIG. 4. Upon a transient demand, the linear voltage regulator folds the current back to 15–20% of its steady-state value, as described earlier. To avoid this, an assist circuit 24 allows the circuit to complete power up. As shown in FIG. 3, the assist circuit 24 schematically bridges the higher voltage $V_1$ and lower voltage $V_2$ outputs, but is physically integrated into the controller 10 board circuitry.

Figure 5:
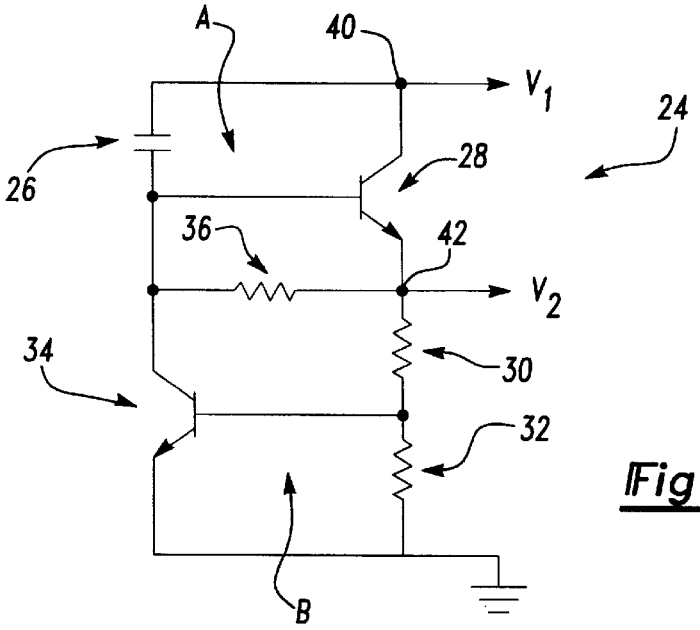
FIG. 5 is a schematic view of a power-up assist circuit of FIG. 3.

FIG. 5 is a circuit schematic detailing the assist circuit 24 of the power supply 12. The circuit comprises two integral yet distinct loops A, B. First loop A comprises a capacitor 26, a first transistor 28, a higher voltage node 40, and lower voltage node 42. Second loop B comprises a plurality of resistors 30, 32, 36, a second transistor 34, and the lower voltage node 42. Upon an initial power up event, such as ignition, the switching power supply begins ramping up the higher voltage $V_1$. As the higher voltage $V_1$ begins ramping, the capacitor 26 begins charging. The positive rate of change of voltage across capacitor 26 provides a base current drive to transistor 28. Transistor 28 becomes saturated, turning on, thus placing a short circuit between nodes 40 and 42. The short circuit allows voltage node 40 to assist by supplying current to lower voltage node 42. If a transient current demand is subsequently placed on the lower voltage node 42, the assistance allows for this demand to be met. It should be noted that the charging of capacitor 26 controls the bridging of higher and lower voltage nodes 40, 42. The bridging will only occur when there exists a positive rate of change of voltage across capacitor 26. Once capacitor 26 is fully charged, the bridging ceases.

Resistors 30 and 32 create a voltage divider, and are sized such that the second transistor 34 becomes saturated and turns on at essentially the same time the lower voltage node 42 achieves a predetermined value. This value is designated as the $V_2$ voltage minus allowable tolerances. Once the second transistor 34 becomes saturated and turns on, the base current of the first transistor 28 is reduced. The first transistor 28 becomes desaturated, turning off, and the short-circuit between nodes 40 and 42 is eliminated. With the second transistor 34 on, the base emitter of the first transistor 28 is reversed biased, preventing it form turning on. At this point, the lower voltage node 42 is now fed by the linear voltage regulator 22 which is fully able to handle any transient current demands. The third resistor 36, disposed between loops A and B, keeps the base emitter of transistor 28 reverse biased when capacitor 26 is discharging. Resistor 36 also aids in providing the base of transistor 28 a DC discharge path to ground.

During the power down sequence, both the higher voltage $V_1$ and lower voltage $V_2$ ramp down towards ground. As a result, second transistor 34 becomes cut-off. The rate of change of voltage across capacitor 26 becomes negative. Thus, base current is not provided to transistor 28, thereby keeping transistor 28 cut-off. Therefore, a short-circuit between higher voltage node 40 and lower voltage node 42 cannot exist during power down.

Overall, the assist circuit 24 of the present invention only provides a short-circuit between higher 40 and lower 42 voltage nodes during the power-up sequence and only until the lower voltage node 42 reaches a predetermined value.

Various other advantages of the present invention will become apparent to those skilled in the art after having the benefit of studying the foregoing text and drawing taken in conjunction with the following claims.

What is claimed is:

1. A power up assist circuit for use with a power supply, comprising:

a first circuit loop, said first circuit loop having a first voltage output; and a second circuit loop, said second circuit loop having a second voltage output such that during an initial power up stage said first circuit loop supplies said second voltage output, said second voltage output being assisted by said first voltage output through said first circuit loop and said second circuit loop causing deactivation of said first circuit loop after said second voltage output achieves a predetermined value such that said first circuit loop no longer supplies said second voltage output.

2. The power up assist circuit of claim 1, further comprising a first switch, wherein in a first mode said first switch enables said second voltage output to be supplied with current from a first power supply source.

3. The power up assist circuit of claim 2, further comprising a capacitor wherein said capacitor activates said first switch during a power up event and prevents said power up assist circuit from activating during a power down event.

4. The power up assist circuit of claim 3, further comprising a resistor disposed between said first and second loops, wherein said resistor reverse biases said capacitor and provides a discharge path to a ground.

5. The power up assist circuit of claim 2, wherein said first switch is a transistor.

6. The power up assist circuit of claim 1, further comprising a second switch, wherein in a first mode said second switch enables said second voltage output to be supplied with current from a second power supply source.

7. The power up assist circuit of claim 6, wherein said second switch is a transistor.

8. A vehicle controller comprising:

at least one sub-controller;

a power supply, said power supply powering said at least one subcontroller, said power supply including:

a first voltage source, said first voltage source providing a first supply voltage;

a first linear voltage regulator, said first linear voltage regulator receiving said first supply voltage and generating a second supply voltage, said second supply voltage being less than said first supply voltage;

a power up assist circuit including:

a first circuit loop, said first circuit loop having a first voltage output; and a second circuit loop, said second circuit loop having a second voltage output such that during an initial power up stage said first circuit loop supplies said second voltage output, said second voltage output being assisted by said first voltage output through said first circuit loop and said second circuit loop causing deactivation of said first circuit loop after said second voltage output achieves a predetermined value such that said first circuit loop no longer supplies said second voltage output.

9. The power up assist circuit of claim 8, further comprising a first switch, wherein in a first mode said first switch enables said second voltage output to be supplied with current from a first power supply source.

10. The power up assist circuit of claim 9, further comprising a capacitor wherein said capacitor activates said first switch during a power up event and prevents said power up assist circuit from activating during a power down event.

11. The power up assist circuit of claim 10, further comprising a resistor disposed between said first and second circuit loops, wherein said resistor reverse biases said capacitor and provides a discharge path to a ground.

12. The power up assist circuit of claim 8, further comprising a second switch, wherein in a first mode said second switch enables said second voltage output to be supplied with current from a second power supply source.

13. A multi-voltage power supply, comprising:

a first voltage source, said first voltage source providing a first supply voltage;

a first linear voltage regulator receiving said first voltage as input, said first linear voltage regulator providing a second voltage, said second voltage being less than said first voltage; and a power up assist circuit positioned between outputs of said first power supply and said first linear voltage regulator, said power up assist circuit supplementing said second voltage during a power up mode.

14. The multi-voltage power supply of claim 13, wherein said power up assist circuit includes:

a first circuit loop, said first circuit loop having a first voltage output; and a second circuit loop, said second circuit loop having a second voltage output such that during an initial power up stage said first circuit loop supplies said second voltage output, said second voltage output being assisted by said first voltage output through said first circuit loop and said second circuit loop causing deactivation of said first circuit loop after said second voltage output achieves a predetermined value such that said first circuit loop no longer supplies said second voltage output.

* * * * *